US011851621B2

(12) United States Patent
Babu et al.

(10) Patent No.: US 11,851,621 B2
(45) Date of Patent: Dec. 26, 2023

(54) NAPHTHA CATALYTIC CRACKING PROCESS

(71) Applicant: SABIC Global Technologies B.V., Bergen op Zoom (NL)

(72) Inventors: Mamilla Sekhar Babu, Geleen (NL); Talal Khaled Al-Shammari, Riyadh (SA)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 17/628,635

(22) PCT Filed: Jun. 30, 2020

(86) PCT No.: PCT/IB2020/056195

§ 371 (c)(1),
(2) Date: Jan. 20, 2022

(87) PCT Pub. No.: WO2021/019326

PCT Pub. Date: Feb. 4, 2021

(65) Prior Publication Data

US 2022/0267685 A1 Aug. 25, 2022

Related U.S. Application Data

(60) Provisional application No. 62/881,205, filed on Jul. 31, 2019.

(51) Int. Cl.
*C10G 51/04* (2006.01)

(52) U.S. Cl.
CPC ..... *C10G 51/04* (2013.01); *C10G 2400/20* (2013.01); *C10G 2400/22* (2013.01); *C10G 2400/30* (2013.01)

(58) Field of Classification Search
CPC ..... C10G 9/36; C10G 11/182; C10G 51/04; C10G 2300/104; C10G 2300/1044;
(Continued)

(56) References Cited

U.S. PATENT DOCUMENTS 4,137,147 A * 1/1979 Franck ..... B01J 29/24 585/315
2013/0267745 A1 10/2013 Schrod et al.
(Continued)

FOREIGN PATENT DOCUMENTS

CN 105339470 2/2016
CN 105452423 3/2016
(Continued)

OTHER PUBLICATIONS

International Search Report and Written Opinion for Application No. PCT/IB2020/056195, dated Sep. 22, 2020, 13 pages.
(Continued)

*Primary Examiner* — Brian A McCaig
(74) *Attorney, Agent, or Firm* — Norton Rose Fulbright US LLP

(57) ABSTRACT

Systems and methods for processing full range naphtha feeds to produce a light olefins stream and an aromatics stream are described. In particular, the invention concerns integration of catalytic cracking with steam cracking to maximize production of aromatics.

16 Claims, 2 Drawing Sheets

(58) Field of Classification Search
CPC ..... C10G 2300/4081; C10G 2400/20; C10G 2400/22; C10G 2400/30
See application file for complete search history.

(56) References Cited

U.S. PATENT DOCUMENTS

| | | | | |
|---|---|---|---|---|
| 2014/0275673 | A1 | 9/2014 | Long et al. | |
| 2016/0097008 | A1 | 4/2016 | Abudawoud et al. | |
| 2016/0369189 | A1 | 12/2016 | Ward et al. | |
| 2016/0369190 | A1 | 12/2016 | Ward et al. | |
| 2017/0009157 | A1 | 1/2017 | Oprins | |
| 2018/0057758 | A1 | 3/2018 | Al-Ghamdi et al. | |
| 2021/0269726 | A1 * | 9/2021 | Al-Majnouni ..... | C10G 69/10 |

FOREIGN PATENT DOCUMENTS

| | | | | | |
|---|---|---|---|---|---|
| CN | 105473691 | | | 4/2016 | |
| CN | 106221786 | | | 12/2016 | |
| CN | 105349179 | B | | 4/2017 | |
| CN | 107001951 | | | 8/2017 | |
| EP | 2828361 | A1 | | 1/2015 | |
| EP | 3305748 | A1 | | 4/2018 | |
| WO | WO 2001/04237 | | * | 1/2001 | ..... C10G 11/00 |
| WO | WO 2016/19204 | | | 2/2016 | |
| WO | WO 2016/098909 | | | 6/2016 | |
| WO | WO 2016/192041 | | | 12/2016 | |

OTHER PUBLICATIONS

Office Action issued in corresponding Chinese Application No. 202080069387.X, dated Jul. 15, 2023.

* cited by examiner

NAPHTHA CATALYTIC CRACKING PROCESS

CROSS REFERENCE TO RELATED APPLICATIONS

This application is a national phase application under 35 U.S.C. § 371 of International Application No. PCT/IB2020/056195, filed Jun. 30, 2020, which claims benefit of priority of U.S. Provisional Patent Application No. 62/881,205 filed Jul. 31, 2019, the entire contents of each of which are hereby incorporated by reference in its entirety.

BACKGROUND OF THE INVENTION

A. Field of the Invention

The invention generally concerns processing full range naphtha feeds to produce a light olefins stream and an aromatics stream. In particular, the invention concerns integration of catalytic cracking with steam cracking to maximize production of olefins and aromatics.

B. Description of Related Art

Ethylene, propylene, butenes, butadiene, and aromatic compounds such as benzene, toluene, and xylene (BTX) are basic intermediates for a large portion of the petrochemical industry. They are mainly obtained through the thermal cracking (sometimes referred to as "steam pyrolysis" or "steam cracking") of petroleum gases and distillates such as naphtha, kerosene, or even gas oil. However, as demands rise for these basic intermediate compounds, other production sources must be considered beyond traditional thermal cracking processes utilizing petroleum gases and distillates as feedstocks.

These intermediate compounds may also be produced through refinery fluidized catalytic cracking (FCC) processes, where heavy feedstocks such as gas oils or residues are converted. For example, an important source for propylene production is refinery propylene from FCC units. However, the distillate feedstocks such as gas oils or residues are usually limited and result from several costly and energy intensive processing steps within a refinery.

Various attempts to produce these intermediate compounds have been described. By way of example U.S. Patent Application Publication No. 2018/0057758 to Al-Ghamdi et al. describes processing a feedstock hydrocarbon into a lesser boiling point hydrocarbon fraction and a greater boiling point hydrocarbon fraction and catalytically cracking the greater boiling point fraction to produce olefins and steam cracking the lesser boiling point hydrocarbons to produce petroleum products. In another example, Chinese Patent Application Publication No. CN 106221786 describes catalytically cracking naphtha in combination with other cracking units to produce petrochemical products. In yet another example, International Application Publication No. WO 2016/19204 describes converting naphtha to lower olefins, light aromatic hydrocarbons, and high octane gasoline by catalytically cracking naphtha in combination with steam cracking of lower alkane and catalytic cracking of higher alkane and higher olefin streams.

While various attempts to enhance production of petrochemical products from naphtha have been described, they involve complicated processing and, thus, can be inefficient.

SUMMARY OF THE INVENTION

A discovery has been made that provides a solution to at least some of the problems associated with conversion of naphtha into high value petroleum products. The discovery is premised on an integrated catalytic cracking and steam cracking process that can use full range naphtha as the feedstock. The full range naphtha can be separated into a first intermediate stream, a heavies stream, an aromatics stream, or a combination thereof. The first intermediate stream can be catalytically cracked to produce an effluent stream having C2 to C12 hydrocarbons. The effluent stream can then be separated into a light intermediate stream and a heavy intermediate stream. At least a portion of the light intermediate stream (e.g., a portion containing paraffins such as ethane, propane, butane, light virgin naphtha, gas oil, gas condensate, or any combination thereof) can be stream cracked to produce olefins. At least a portion of the light intermediate stream can be subjected to separation steps to extract ethylene, propylene, butadiene, and/or 1-butene. The olefins can be combined with the effluent stream to produce a product stream that includes light olefins and BTX. The heavy intermediate stream can be combined with the first intermediate stream and then further processed to continue the cycle. The effluent stream and/or product stream can be separated into a light olefins stream(s), a paraffins stream(s), and a BTX stream. The paraffins stream(s) can be provided to the steam cracking process to continue the cycle of producing BTX and light olefins. Such an integrated process can provide high value petrochemical products in a more efficient manner as only one catalytic cracker and one steam cracker are necessary. The process also generates heat and/or fuel for the catalytic cracking process.

In one aspect of the present invention, methods to produce olefins and/or BTX are described. A method can include: (a) separating a feed stream comprising full range naphtha that has an initial boiling point of 20° C. and a final boiling point of 250° C. to form a first intermediate stream and a heavies stream; (b) contacting the first intermediate stream with a catalyst under catalytic cracking conditions sufficient to cause cracking of hydrocarbons in the first intermediate stream to form an effluent stream comprising C2 to C12 hydrocarbons; (c) separating the effluent stream to produce a light intermediate stream that can include C5-hydrocarbons, and a heavy intermediate stream that can include C5+ hydrocarbons; and (d) subjecting at least a portion of the light intermediate stream to steam cracking conditions sufficient to convert hydrocarbons (e.g., paraffins) in the light intermediate stream to olefins, and producing a product stream that can include one or more of ethylene, propylene, butene, benzene, toluene, and xylene. In some embodiments, the heavy intermediate stream that includes C5+ hydrocarbons can be separated to produce a first aromatics stream that includes benzene, toluene, and xylene, or any combination thereof, and a stream that includes C6+ hydrocarbons. The C6+ hydrocarbons stream can be provided to the separating of step (a) to continue the cycle. The separating of step (a) can produce a second aromatics stream that includes benzene, toluene, and xylene, which can be purified to produce streams of benzene, toluene, and xylene. The produced olefins from step (d) can be combined with the effluent stream of step (b) to produce the product stream that includes one or more of ethylene, propylene, butene, benzene, toluene, and xylene.

In some embodiment, the method can include cooling the effluent stream from step (b) and providing the cooled effluent stream to step (c). Cooling can include heat transfer and/or quenching of the effluent stream; producing a cooled effluent stream and a light hydrocarbons stream. The cooled effluent stream can be provided to step (c) and the light hydrocarbon stream can be combusted to generate heat for the catalytic cracking of step (b). Thus, making the method energy efficient. The cooled effluent stream can be separated to produce the light intermediate stream that includes C5− hydrocarbons and the heavy intermediate stream that includes C5+ hydrocarbons. The product stream can be separated to produce a second light intermediate stream that includes C5− hydrocarbons, and second heavy intermediate stream comprising C5+ hydrocarbons. The second heavy intermediate stream that includes the C5+ hydrocarbon stream can be separated to obtain a third aromatic stream that includes at least one of benzene, toluene, and xylene, and a non-aromatics stream that includes C6+ hydrocarbons and providing the non-aromatics stream that includes the C6+ hydrocarbons to step (a). The streams that include benzene, toluene, xylene, or any combination thereof (e.g., the first, second, and third aromatics stream) can be separated to obtain streams of benzene, toluene, and xylene.

In some embodiments, separating the effluent stream or the product stream can be performed using any methods known in the art to separate liquid and gaseous streams (e.g., compression, distillation, membrane separation and the like). Separating the effluent stream or the product stream can produce an intermediate stream or a second light intermediate stream, and the heavy intermediate stream or second heavy intermediate stream. In embodiments, the second light intermediate stream can be produced and provided to step (d). The light intermediate stream or the compressed second light intermediate stream can be subjected to conditions suitable to separate C2 to C4 olefins from the light intermediate stream or the second light intermediate stream and produce streams of ethylene, propylene, C4 olefins, and a C2 to C4 paraffins stream. The C2 to C4 paraffins stream can be provided to the steam cracking of step (d) to continue the process. Separation can include at least one of the following: de-methanizing the compressed light intermediate stream or the compressed second light intermediate stream to produce methane and a C2+ hydrocarbons stream; de-ethanizing the C2+ hydrocarbons stream to produce a C2 hydrocarbons stream and a C3+ hydrocarbons stream and separating the C2 hydrocarbons stream to produce an ethylene stream and a ethane stream; de-propanizing the C3+ hydrocarbons stream to produce a C4+ hydrocarbons stream and separating the C3 hydrocarbons stream to produce a propylene stream and a propane stream; de-butanizing the C4+ hydrocarbons stream to produce a C4 hydrocarbons stream and a C5+ hydrocarbons stream, and providing the C5+ hydrocarbons stream to the heavy intermediate stream; separating the C4 hydrocarbons stream to produce a C4 olefins stream and a butane stream; providing at least one of the ethane, propane, and butane streams to step (d); and a combination thereof. At least two of the ethane, propane and butane streams are combined to form the at least a portion of the light intermediate stream provided to step (d) steam cracking.

In the method of the present invention, the catalytic cracking conditions can include a temperature of 600 to 750° C., a pressure of 1.5 to 2.5 bar, and a residence time of 1 to 10 seconds. A catalytic cracking catalyst can include aluminum, silica, zeolite, or combinations thereof. Steam cracking conditions can include a temperature of 800 to 900° C., a steam to hydrocarbon ratio of 0.2 to 0.7, and a residence time of 100 to 5000 ms.

Other embodiments of the invention are discussed throughout this application. Any embodiment discussed with respect to one aspect of the invention applies to other aspects of the invention as well and vice versa. Each embodiment described herein is understood to be embodiments of the invention that are applicable to other aspects of the invention. It is contemplated that any embodiment or aspect discussed herein can be combined with other embodiments or aspects discussed herein and/or implemented with respect to any method or composition of the invention, and vice versa. Furthermore, compositions and kits of the invention can be used to achieve methods of the invention.

The following includes definitions of various terms and phrases used throughout this specification.

The term "cracking" as the term is used herein and in the claims means technology for breaking higher molecular weight hydrocarbons into lower molecular weight hydrocarbons and includes both fluid catalytic cracking and steam cracking.

The phrase "full range naphtha" refers to a hydrocarbon mixture that has an initial boiling point range of 20° C. to 35° C. and a final boiling point range of 200° C. to 250° C.

The term "Cn+ hydrocarbon" wherein n is a positive integer, e.g. 1, 2, 3, 4, or 5, as that term is used in the specification and/or claims, means any hydrocarbon having at least n number of carbon atom(s) per molecule.

The terms "about" or "approximately" are defined as being close to as understood by one of ordinary skill in the art. In one non-limiting embodiment, the terms are defined to be within 10%, preferably within 5%, more preferably within 1%, and most preferably within 0.5%.

The terms "wt. %," "vol. %," or "mol. %" refers to a weight percentage of a component, a volume percentage of a component, or molar percentage of a component, respectively, based on the total weight, the total volume of material, or total moles, that includes the component. In a non-limiting example, 10 grams of component in 100 grams of the material is 10 wt. % of component.

The term "substantially" and/or "primarily and its variations is defined to include ranges within 10%, within 5%, within 1%, or within 0.5%.

The terms "inhibiting" or "reducing" or "preventing" or "avoiding" or any variation of these terms, when used in the claims and/or the specification includes any measurable decrease or complete inhibition to achieve a desired result.

The term "effective," as that term is used in the specification and/or claims, means adequate to accomplish a desired, expected, or intended result.

The use of the words "a" or "an" when used in conjunction with any of the terms "comprising," "including," "containing," or "having" in the claims, or the specification, may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The methods of the present invention can "comprise," "consist essentially of," or "consist of" particular ingredients, components, compositions, etc. disclosed throughout the specification. With respect to the transitional phrase "consisting essentially of," in one non-limiting aspect, a basic and novel characteristic of the methods of the present invention is their abilities to efficiently produce BTX and olefins from a heavy/full range naphtha feed by integrating catalytic cracking with steam cracking.

The term "primarily," as that term is used in the specification and/or claims, means greater than any of 50 wt. %, 50 mol. %, and 50 vol. %. For example, "primarily" may include 50.1 wt. % to 100 wt. % and all values and ranges there between, 50.1 mol. % to 100 mol. % and all values and ranges there between, or 50.1 vol. % to 100 vol. % and all values and ranges there between.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings.

Figure 1:
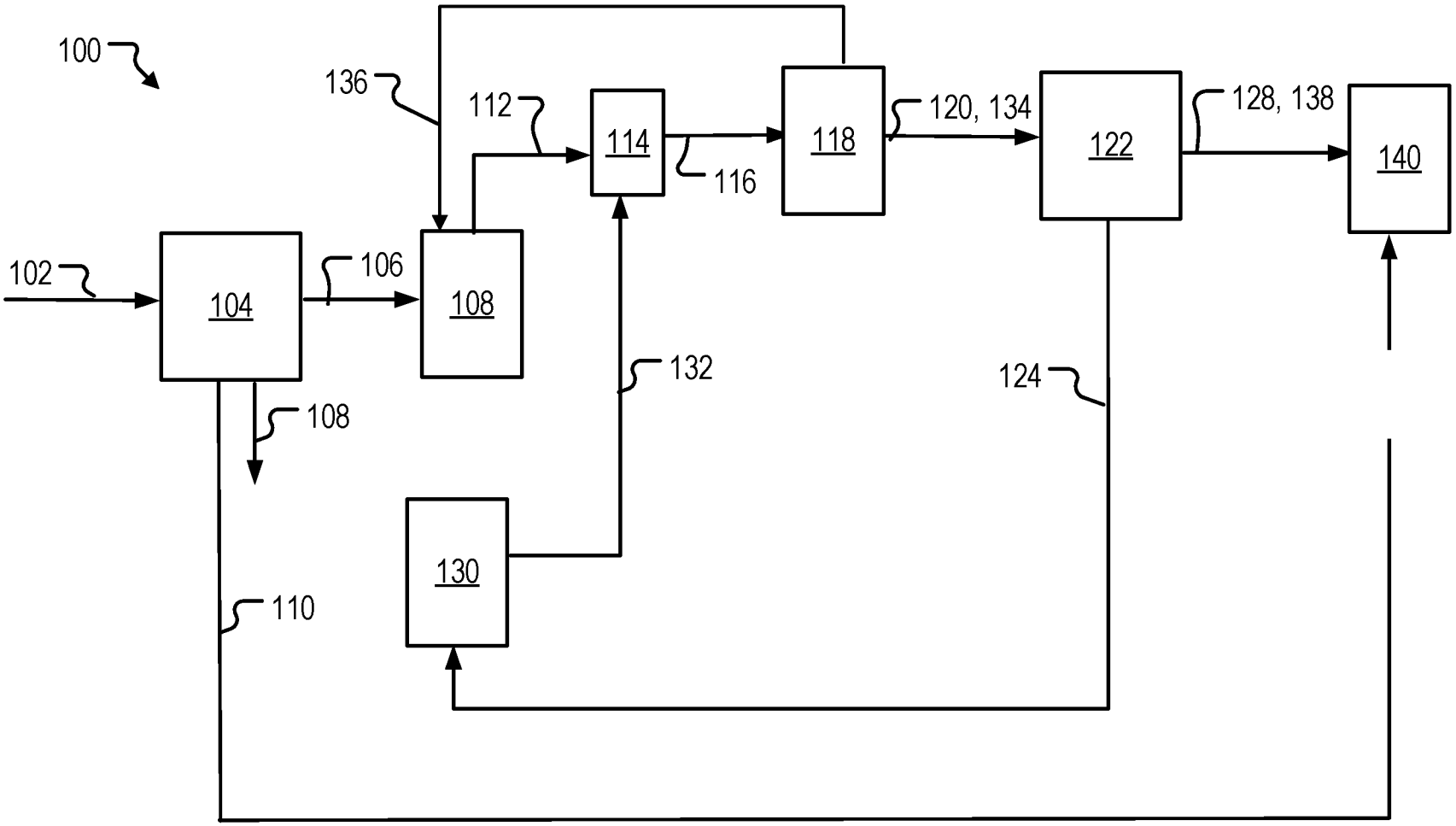
FIG. 1 shows an illustration of a system of the present invention to produce olefins and aromatics.

While the invention is susceptible to various modifications and alternative forms, specific embodiments thereof are shown by way of example in the drawings. The drawings may not be to scale.

DETAILED DESCRIPTION OF THE INVENTION

A discovery has been made that provides a solution to at least some of the problems associated with producing ethylene, propylene, butenes, benzene, toluene, and xylene. The discovery is premised in an integrated system that is capable of using full range naphtha to produce olefins and aromatics (e.g., BTX). The integrated system includes a catalytic hydrocarbon cracking unit and hydrocarbon steam cracking unit in addition to one or more separation units.

These and other non-limiting aspects of the present invention are discussed in further detail in the following sections with reference to the figures. The units in the system can include one or more heating and/or cooling devices (e.g., insulation, electrical heaters, jacketed heat exchangers in the wall) or controllers (e.g., computers, flow valves, automated values, etc.) that can be used to control the reaction temperature and pressure of the units.

FIG. 1 shows an illustration of system 100 to produce olefins and BTX from full range naphtha. In system 100, full range naphtha 102 can enter feed conditioning and preheating unit 104. In unit 104, the full range naphtha can be heated to a temperature of 150 to 350° C. Treating of the full range naphtha can separate the full range naphtha into a first intermediate stream 106 and heavies stream 108. Heavies stream 108 can have $C_{12}$+ hydrocarbons. In some embodiments, first aromatics stream 110 can be produced. First aromatics stream 110 can include benzene, toluene, xylene or combinations. First intermediate stream 106 can include C6+ hydrocarbons and can enter catalytic cracking unit 108. Catalytic cracking unit 108 can be any known catalytic cracking unit. By way of example, a fluid catalytic cracking also known as a fluid catalytic unit ("FCCU" or "FCU") are commonly used processes in all modern oil refineries. Cracking can take place using a zeolite-based catalyst in a short-contact time vertical or upward-sloped pipe called the "riser." Pre-heated feed can be contacted with a fluidized catalyst under conditions suitable to crack the full range naphtha feedstock. Cracking conditions can include temperature, pressure, weight hourly space velocity, residence time or a combination thereof. The catalytic cracking temperature can range from 600 to 750° C. A reaction pressure can be 1.5 to 2.5 bara. The residence time can be 1 to 10 seconds. Suitable catalytic cracking catalysts can include zeolite-based catalysts such as HZSM-5. The heated catalyst can vaporize the feed and catalyzes the cracking reactions that break down the full range naphtha into lighter hydrocarbon (lower molecular weight) components. The catalyst-hydrocarbon mixture can flow upward through the riser, and then the mixture can be separated via cyclones to produce effluent stream 112, which is substantially free of catalyst, and spent catalyst. The catalyst-free hydrocarbons can be routed to heat recovery unit 114. Spent catalyst can be disengaged from the cracked hydrocarbon vapors and be sent to a catalyst regeneration unit (not shown) where it can be regenerated and returned to catalytic cracking unit 104. Non-limiting examples of suitable fluid catalytic cracking units include, those based on technology available for license from UOP and KBR Orthoflow.

Effluent stream 112 can enter heat recovery unit 114. In heat recovery unit 114, effluent stream 112 can be cooled, thus quenching the reaction, and the heat recovered from the effluent stream can be provided to catalytic cracking unit 108 (e.g., through a flue gas recovery unit (not shown)). Cooled effluent stream 116 can enter quenching unit 118 to further stop the cracking reaction and produce cooled quenched effluent stream 120. Quenching unit 118 can include an oil quench tower, a water quench tower, or a combination of both.

Cooled quenched effluent stream 120 can exit quenching unit 118 and enter separation unit 122. In separation unit 122, the effluent stream 120 can be separated into light intermediate stream 124 that includes C5− hydrocarbons, and a heavy intermediate stream that includes C5+ hydrocarbons (See, for example, stream 206 in FIG. 2). Heavy intermediate stream can be separated into second aromatic aromatics stream 128. Separation unit 122 can include one or more units known in the art to separate hydrocarbons into desired streams. A non-limiting illustration is described in FIG. 2.

Light intermediate stream 124 can include C2 to C4 saturated hydrocarbons, which can exit separation unit 122 and enter steam cracking unit 130. In steam cracking unit 130, the C2 and C4 saturated hydrocarbons can be subjected to conditions to produce smaller molecular weight hydrocarbons (e.g., methane, ethylene, propylene, butenes, etc.). By way of example, at least a portion of the light intermediate stream 124 can be diluted with steam and heated in a furnace without the presence of oxygen under conditions suitable to crack the C2 to C4 hydrocarbons. Steam cracking conditions can include temperature, pressure, weight hourly space velocity, residence time or a combination thereof. The steam cracking temperature can range from 800 to 900° C. The residence time can be 100 to 5000 milliseconds (ms). After the cracking, the olefins stream 132 can exit steam cracking unit 130 and enter quenching unit 118. In quenching unit 118, the hydrocarbons in olefins stream 132 can be combined with effluent stream 112 or cooled effluent stream 116 to produce product stream 134, and produce light hydrocarbons stream 136. Product stream 134 is a mixture of olefins (e.g., ethylene, propylene, butene, and/or butadiene, pentene, pentane) and C5+ hydrocarbons (e.g., pentane, pentene, hexane, heptane, octane, benzene, xylene, and/or toluene and the like). Light hydrocarbons stream 136 (e.g., methane) can be used a fuel for catalytic cracking unit 108. In some embodiments, light hydrocarbons stream 136 is not produced.

Product stream 134 can be separated to produce a second light intermediate stream that includes C5− hydrocarbons, and second heavy intermediate stream that includes C5+ hydrocarbons as described for cooled quenched effluent stream 120. C5+ hydrocarbons can be separated to produce third aromatics stream 138. Once olefins stream 132 can be generated, cooled effluent stream 114 and olefins stream 132 can be continuously produced, combined, and separated to produce aromatics (e.g., BTX), olefins (e.g., ethylene, propylene, butene), and light intermediate stream 124.

First aromatics stream 110 and/or second aromatics stream 128 or third aromatics stream 138 can exit aromatics extraction unit 140. In extraction unit 140, streams of benzene, toluene, xylene and non-aromatics can be produced. The extraction unit can be any unit or system that extracts aromatic species from non-aromatic species known in the art. By way of example, a liquid-liquid extraction system or extractive distillation unit or both can be used. The extraction unit can produce a benzene stream, a toluene stream, a xylene stream or any combination thereof (e.g., a benzene/toluene stream, a benzene/xylene stream, toluene/xylene stream, and the like).

Figure 2:
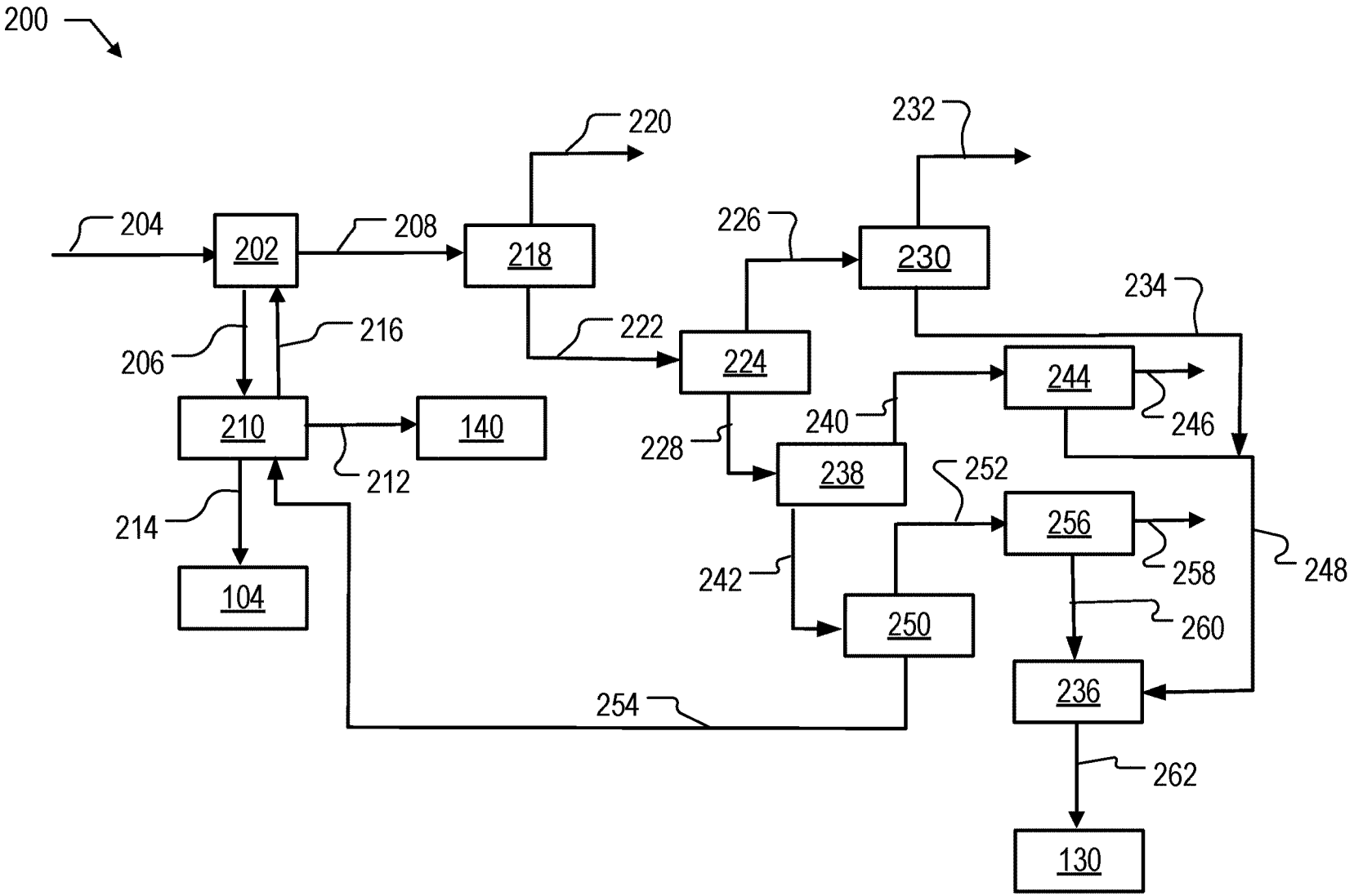
FIG. 2 shows an illustration of a system of the present invention to separate C2 to C5 hydrocarbon streams.

Referring to FIG. 2, a non-limiting example of separation unit 122 is illustrated. Separation unit 122 can include one or more separation units capable of separating a C5+ hydrocarbons stream and a C5− hydrocarbon stream (e.g., streams 120, 134 of FIG. 1) into multiple product streams of value. By way of example, separation unit can include one or more compressors, a de-methanizer, a de-ethanizer, a de-propanizer, a de-butanizer, a de-hexanizer and the like. Separation unit or facility can also be capable of purifying streams to removes impurities such as oxygen, organic acids and the like. Such units are known in the art.

Compressor unit 202, can receive product stream 134 or cooled quenched stream 120 (hereinafter hydrocarbon stream 204) and compress hydrocarbon stream 204 and produce C5+ hydrocarbons stream 206 (e.g., heavy intermediate stream 126) and C5− hydrocarbons stream 208 (e.g., light intermediate stream 124). Compressor unit 202 can be a 2 stage compressor. C5+ hydrocarbons stream 206 can enter de-hexanizer 210 and be separated into an aromatics stream 212, and non-aromatics stream 214, light C5− hydrocarbon stream 216. Aromatics stream 212 (e.g., second and/or third aromatics stream 128, 138) can enter aromatic extraction unit 140 and be processed as described above. Non-aromatics stream 214 can include C6+ hydrocarbons that are not aromatic, for example, C6 to C12 alkanes and alkenes. Non-limiting examples of C6 to C12 alkanes and alkenes include hexane, hexene, heptane, heptene, octane, octene, nonane, nonene, decane, decene, undecane, undecene, dodecane, and dodecene. Non-aromatics stream 214 can exit de-hexanizer 210 and enter feed conditioning unit (e.g., a separation unit) 104 and/or be mixed with full range naphtha 102 to continue the process. Light C5− hydrocarbon stream 216 can exit de-hexanizer 210 and enter compress unit 202 to be further processed.

C5− hydrocarbons stream 208 (e.g., light intermediate stream 124) can exit compressor 202 and enter de-methanizer unit 218. In de-methanizer unit 218, methane stream can be separate from C5− hydrocarbons stream 208 to produce methane stream 220 and C2 to C5 hydrocarbons stream 222. Methane stream 220 be stored, transported, and/or provided to other processing units.

C2 to C5 hydrocarbons stream 222 can exit de-methanizer unit 218 and enter de-ethanizer unit 224. In de-ethanizer unit 224, C2 hydrocarbons can be separated from C2 to C5 hydrocarbons stream 222 to produce C2 hydrocarbons stream 226 and C3 to C5 hydrocarbons stream 228. C2 hydrocarbons stream 226 can enter separation unit 230 where ethylene stream 232 and ethane stream 234 can be produced. Ethane 234 can exit separation unit 230 and be stored in collection unit 236. Ethylene stream 232 can be stored, transported, and/or provided to other processing units.

C3 to C5 hydrocarbons stream 228 can exit de-ethanizer unit 224 and enter de-propanizer unit 238. In de-propanizer unit 238, C3 hydrocarbons, which includes propane and propylene, can be separated from C3 to C5 hydrocarbons stream 228 to produce C3 hydrocarbons stream 240 and C4 to C5 hydrocarbons stream 242. C3 hydrocarbons stream 240 can enter separation unit 244 where propylene stream 246 and propane stream 248 can be produced. Propane stream 248 can exit separation unit 230 and be stored in collection unit 236. Propylene stream 246 can be stored, transported, and/or provided to other processing units.

C4 to C5 hydrocarbons stream 242 can exit de-ethanizer unit 238 and enter de-butanizer unit 250. In de-butanizer unit 250, C4 hydrocarbons, which includes butane, butenes and butadiene, can be separated from C4 to C5 hydrocarbons stream 242 to produce C4 hydrocarbons stream 252 and C5 hydrocarbons stream 254. C4 hydrocarbons stream 252 can enter separation unit 256 where C4 olefins stream 258, which includes butenes and butadiene, and butane stream 260 can be produced. Butane stream 260 can exit separation unit 260 and be stored in collection unit 236. C4 olefins stream 258 can be stored, transported, and/or provided to other processing units. C5 hydrocarbons stream 254 can be provided to de-hexanizer unit 210 and/or compressor 202 for further processing. In collection unit 236, C2 to C4 alkanes can be collected and provided as separate streams or a collective hydrocarbon stream 262 to steam cracking unit 130 to continue the production of value added products of ethylene, propylene and C4 olefins. In some embodiments, hydrocarbon stream 262 is the light intermediate stream 124.

In the context of the present invention, at least the following 20 embodiments are described. Embodiment 1 is a method of producing olefins, aromatics, or combinations thereof. The method includes: (a) separating a feed stream containing full range naphtha having an initial boiling point of 20° C. and a final boiling point of 250° C. to form a first intermediate stream and a heavies stream; (b) contacting the first intermediate stream with a catalyst under catalytic cracking conditions sufficient to cause cracking of hydrocarbons in the first intermediate stream to form an effluent stream containing C2 to C12 hydrocarbons; (c) separating the effluent stream to produce a light intermediate stream containing C5-hydrocarbons, and a heavy intermediate stream containing C5+ hydrocarbons; and (d) subjecting at least a portion of the light intermediate stream of step (c) containing C5-hydrocarbons to steam cracking conditions sufficient to convert hydrocarbons in the light intermediate stream to olefins, and producing a product stream containing one or more of ethylene, propylene, butene, benzene, toluene, and xylene. Embodiment 2 is the method of embodiment 1, further including combining the produced olefins from step (d) with the effluent stream of step (b) to produce the product stream. Embodiment 3 is the method of either one of embodiments 1 or 2, further including separating the heavy intermediate stream containing C5+ hydrocarbons to produce a first aromatics stream containing benzene, toluene, and xylene, or any combination thereof, and a stream containing C6+ hydrocarbons. Embodiment 4 is the method of embodiment 3, further including providing the C6+ hydrocarbons stream to the separating of step (a). Embodiment 5 is the method of embodiment 4, wherein the step (a) separating step further forms a second aromatic stream containing benzene, toluene, and xylene. Embodiment 6 is the method of any one of embodiments 1 to 5, further including cooling the effluent stream from step (b) and providing the cooled effluent stream to step (c). Embodiment 7 is the method of embodiment 6, wherein cooling the effluent stream from step (b) produces a light hydrocarbons stream, and combusting the light hydrocarbon stream to generate heat for the catalytic cracking of step (b). Embodiment 8 is the method of either of embodiments 6 or 7, further including separating the cooled effluent stream to produce the light intermediate stream containing C5-hydrocarbons and the heavy intermediate stream containing C5+ hydrocarbons. Embodiment 9 is the method of embodiment 8, further including separating the product stream to produce a second light intermediate stream containing C5− hydrocarbons, and second heavy intermediate stream containing C5+ hydrocarbons. Embodiment 10 is the method of embodiment 9, further including separating the second heavy intermediate stream containing C5+ hydrocarbon stream to obtain a third aromatic stream containing benzene, toluene, and xylene and a non-aromatics stream containing C6+ hydrocarbons and providing the non-aromatics stream containing C6+ hydrocarbons to step (a). Embodiment 11 is the method of any one of embodiments 1 to 10, further including separating at least one of the first, second or third aromatics streams to obtain streams of benzene, toluene, and xylene. Embodiment 12 is the method of any one of embodiments 1 to 11, wherein separating the effluent stream or the product stream includes compressing the effluent stream or the product stream to produce a compressed intermediate stream or a compressed second light intermediate stream, and the heavy intermediate stream or second heavy intermediate stream. Embodiment 13 is the method of embodiment 12, wherein the second light intermediate stream is produced and the second light intermediate stream is provided to step (d). Embodiment 14 is the method of either one of embodiments 12 or 13, wherein the compressed light intermediate stream or the compressed second light intermediate stream are subjected to conditions suitable to separate C2 to C4 olefins from the light intermediate stream or the second light intermediate stream and produce streams of ethylene, propylene, C4 olefins, and a C2 to C4 paraffins stream. Embodiment 15 is the method of embodiment 14, wherein the C2 to C4 paraffins stream is provided to the steam cracking of step (d). Embodiment 16 is the method of either of embodiments 14 or 15, wherein the conditions include de-methanizing the compressed light intermediate stream or the compressed second light intermediate stream to produce methane and a C2+ hydrocarbons stream. The method also includes de-ethanizing the C2+ hydrocarbons stream to produce a C2 hydrocarbons stream and a C3+ hydrocarbons stream and separating the C2 hydrocarbons stream to produce an ethylene stream and a ethane stream. In addition, the method includes de-propanizing the C3+ hydrocarbons stream to produce a C3 hydrocarbons stream and C4+ hydrocarbons stream and separating the C3 hydrocarbons stream to produce a propylene stream and a propane stream. The method further includes de-butanizing the C4+ hydrocarbons stream to produce a C4 hydrocarbons stream and a C5+ hydrocarbons stream, and providing the C5+ hydrocarbons stream to the heavy intermediate stream. The method also includes separating the C4 hydrocarbons stream to produce a C4 olefins stream and a butane stream, and providing at least one of the ethane, propane, and butane streams to step (d). Embodiment 17 is the method of embodiment 16, wherein at least two of the ethane, propane and butane streams are combined to form the at least a portion of the light intermediate stream provided to step (d). Embodiment 18 is the method of any one of embodiments 1 to 17, wherein the catalytic cracking conditions include a temperature of 600 to 750° C., a pressure of 1.5 to 2.5 bara, and a residence time of 1 to 10 seconds. Embodiment 19 is the method of embodiment 18, wherein the catalytic cracking catalyst contains aluminum, silica, zeolite, or combinations thereof. Embodiment 20 is the method of any one of embodiments 1 to 19, wherein the steam cracking conditions include a temperature of 800 to 900° C., a steam to hydrocarbon ratio of 0.2 to 0.7, and a residence time of 100 to 5000 ms.

Although embodiments of the present application and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the above disclosure, processes, machines, manufacture, compositions of matter, means, methods, or steps, presently existing or later to be developed that perform substantially the same function or achieve substantially the same result as the corresponding embodiments described herein can be utilized. Accordingly, the appended claims are intended to include within their scope such processes, machines, manufacture, compositions of matter, means, methods, or steps.

The invention claimed is:

1. A method of producing olefins, aromatics, or combinations thereof, the method comprising:

(a) separating a feed stream comprising full range naphtha having an initial boiling point of 20° C. and a final boiling point of 250° C. to form a first intermediate stream comprising C6 and C6+ hydrocarbons and a heavies stream comprising only C12+ hydrocarbons;

(b) contacting the first intermediate stream with a catalyst under catalytic cracking conditions sufficient to cause cracking of hydrocarbons in the first intermediate stream to form an effluent stream comprising C2 to C12 hydrocarbons;

(c) separating the effluent stream to produce a light intermediate stream comprising C5− hydrocarbons, and a heavy intermediate stream comprising C5+ hydrocarbons; and (d) subjecting at least a portion of the light intermediate stream of step (c) comprising C5− hydrocarbons to steam cracking conditions sufficient to convert hydrocarbons in the light intermediate stream to olefins, and producing a product stream comprising one or more of ethylene, propylene, butene, benzene, toluene, and xylene;

(e) cooling the effluent stream from step (b) and providing the cooled effluent stream to step (c);

wherein cooling the effluent stream from step (b) produces a light hydrocarbons stream, and combusting the light hydrocarbon stream to generate heat for the catalytic cracking of step (b);

wherein separating the effluent stream or the product stream comprises compressing the effluent stream or the product stream to produce a compressed intermediate stream or a compressed second light intermediate stream, and the heavy intermediate stream or second heavy intermediate stream;

wherein the steam cracking conditions comprise a temperature of 800 to 900° C.; and wherein the catalytic cracking conditions comprise a temperature of 600 to 750° C., a pressure of 1.5 to 2.5 bara, and a residence time of 1 to 10 seconds.

2. The method of claim 1, further comprising combining the produced olefins from step (d) with the effluent stream of step (b) to produce the product stream.

3. The method of claim 1, further comprising separating the heavy intermediate stream comprising C5+ hydrocarbons and benzene, toluene and xylene, or combinations thereof, to produce a first aromatics stream comprising benzene, toluene, and xylene, or any combination thereof.

4. The method of claim 1, further comprising separating the cooled effluent stream to produce the light intermediate stream comprising C5− hydrocarbons and the heavy intermediate stream comprising C5+ hydrocarbons.

5. The method of claim 4, further comprising separating the product stream to produce a second light intermediate stream comprising C5− hydrocarbons, and second heavy intermediate stream comprising C5+ hydrocarbons.

6. The method of claim 5, further comprising separating the second heavy intermediate stream comprising C5+ hydrocarbon stream to obtain a third aromatic stream comprising benzene, toluene, and xylene and a non-aromatics stream comprising C6+ hydrocarbons and providing the non-aromatics stream comprising C6+ hydrocarbons to step (a).

7. The method of claim 5, wherein the second light intermediate stream is produced and the second light intermediate stream is provided to step (d).

8. The method of claim 1, wherein the compressed light intermediate stream or the compressed second light intermediate stream are subjected to conditions suitable to separate C2 to C4 olefins from the light intermediate stream or the second light intermediate stream and produce streams of ethylene, propylene, C4 olefins, and a C2 to C4 paraffins stream.

9. The method of claim 8, wherein the C2 to C4 paraffins stream is provided to the steam cracking of step (d).

10. The method of claim 8, wherein the conditions comprise:

de-methanizing the compressed light intermediate stream or the compressed second light intermediate stream to produce methane and a C2+ hydrocarbons stream;

de-ethanizing the C2+ hydrocarbons stream to produce a C2 hydrocarbons stream and a C3+ hydrocarbons stream and separating the C2 hydrocarbons stream to produce an ethylene stream and an ethane stream;

de-propanizing the C3+ hydrocarbons stream to produce a C3 hydrocarbons stream and C4+ hydrocarbons stream and separating the C3 hydrocarbons stream to produce a propylene stream and a propane stream;

de-butanizing the C4+ hydrocarbons stream to produce a C4 hydrocarbons stream and a C5+ hydrocarbons stream, and providing the C5+ hydrocarbons stream to the heavy intermediate stream;

separating the C4 hydrocarbons stream to produce a C4 olefins stream and a butane stream; and providing at least one of the ethane, propane, and butane streams to step (d).

11. The method of claim 10, wherein at least two of the ethane, propane and butane streams are combined to form the at least a portion of the light intermediate stream provided to step (d).

12. The method of claim 1, wherein the catalytic cracking conditions comprise a temperature of 750° C., a pressure of 2.5 bara, and a residence time of 10 seconds.

13. The method of claim 12, wherein the catalytic cracking catalyst comprises aluminum, silica, zeolite, or combinations thereof.

14. The method of claim 1, wherein the steam cracking conditions comprise a residence time of 100 to 5000 ms.

15. A method of producing olefins, aromatics, or combinations thereof, the method comprising:

(a) separating a feed stream comprising full range naphtha having an initial boiling point of 20° C. and a final boiling point of 250° C. to form a first intermediate stream comprising C6 and C6+ hydrocarbons and a heavies stream comprising only C12+ hydrocarbons;

(b) contacting the first intermediate stream with a catalyst under catalytic cracking conditions sufficient to cause cracking of hydrocarbons in the first intermediate stream to form an effluent stream comprising C2 to C12 hydrocarbons;

(c) separating the effluent stream to produce a light intermediate stream comprising C5− hydrocarbons, and a heavy intermediate stream comprising C5+ hydrocarbons;

(d) subjecting at least a portion of the light intermediate stream of step (c) comprising C5− hydrocarbons to steam cracking conditions sufficient to convert hydrocarbons in the light intermediate stream to olefins, and producing a product stream comprising one or more of ethylene, propylene, butene, benzene, toluene, and xylene;

(e) separating the heavy intermediate stream comprising C5+ hydrocarbons to produce a first aromatics stream comprising benzene, toluene, and xylene, or any combination thereof, and a stream comprising C6+ hydrocarbons; and (f) providing the C6+ hydrocarbons stream to the separating of step (a).

16. A method of producing olefins, aromatics, or combinations thereof, the method comprising:

(a) separating a feed stream comprising full range naphtha having an initial boiling point of 20° C. and a final boiling point of 250° C. to form a first intermediate stream comprising C6 and C6+ hydrocarbons and a heavies stream comprising only C12+ hydrocarbons;

(b) contacting the first intermediate stream with a catalyst under catalytic cracking conditions sufficient to cause cracking of hydrocarbons in the first intermediate stream to form an effluent stream comprising C2 to C12 hydrocarbons;

(c) separating the effluent stream to produce a light intermediate stream comprising C5− hydrocarbons, and a heavy intermediate stream comprising C5+ hydrocarbons;

(d) subjecting at least a portion of the light intermediate stream of step (c) comprising C5− hydrocarbons to steam cracking conditions sufficient to convert hydrocarbons in the light intermediate stream to olefins, and producing a product stream comprising one or more of ethylene, propylene, butene, benzene, toluene, and xylene;

(e) cooling the effluent stream from step (b) and providing the cooled effluent stream to step (c);

(f) separating the cooled effluent stream to produce the light intermediate stream comprising C5− hydrocarbons and the heavy intermediate stream comprising C5+ hydrocarbons;

(g) separating the product stream to produce a second light intermediate stream comprising C5− hydrocarbons, and second heavy intermediate stream comprising C5+ hydrocarbons; and (h) separating the second heavy intermediate stream comprising C5+ hydrocarbon stream to obtain a third aromatic stream comprising benzene, toluene, and xylene and a non-aromatics stream comprising C6+ hydrocarbons and providing the non-aromatics stream comprising C6+ hydrocarbons to step (a).

* * * * *